US008820273B2

(12) United States Patent
Kashiwa

(10) Patent No.: US 8,820,273 B2
(45) Date of Patent: Sep. 2, 2014

(54) VARIABLE COMPRESSION RATIO INTERNAL COMBUSTION ENGINE AND METHOD FOR DISCHARGING COOLANT FROM VARIABLE COMPRESSION RATIO INTERNAL COMBUSTION ENGINE

(75) Inventor: Masaaki Kashiwa, Gotenba (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 742 days.

(21) Appl. No.: 12/086,861

(22) PCT Filed: Jun. 11, 2007

(86) PCT No.: PCT/IB2007/001567

§ 371 (c)(1),
(2), (4) Date: Jun. 20, 2008

(87) PCT Pub. No.: WO2007/144743

PCT Pub. Date: Dec. 21, 2007

(65) Prior Publication Data

US 2009/0126660 A1 May 21, 2009

(30) Foreign Application Priority Data

Jun. 12, 2006 (JP) ..... 2006-162564

(51) Int. Cl.

| | |
|---|---|
| ***F02F 1/10*** | (2006.01) |
| ***F01P 1/02*** | (2006.01) |
| ***F01P 9/00*** | (2006.01) |
| ***F01P 3/14*** | (2006.01) |
| ***F01P 11/02*** | (2006.01) |
| *F02F 7/00* | (2006.01) |
| *F01P 3/02* | (2006.01) |
| *F02B 75/04* | (2006.01) |

(52) U.S. Cl.

CPC ..... *F01P 11/0276* (2013.01); *F02F 7/0065* (2013.01); *F01P 2003/021* (2013.01); *F02B 75/041* (2013.01)

USPC ..... 123/41.72; 123/41.79; 123/41.67; 123/41.01; 123/41.78

(58) Field of Classification Search

USPC .... 123/80 C, 65 W, 78 C, 73 B, 65 V, 65 VA, 123/41.08, 41.09, 190.3, 184.22, 74 D, 123/74 AE, 73 PP, 73 V, 73 R, 500, 501, 503, 123/504, 561, 41.72

See application file for complete search history.

(56) References Cited

U.S. PATENT DOCUMENTS 1,328,261 A * 1/1920 Blankenburg ..... 123/43 A
1,360,366 A 11/1920 Charter (Continued)

FOREIGN PATENT DOCUMENTS

CN 86 1 03731 A 2/1987
DE 103 52 737 A1 6/2005

(Continued)

OTHER PUBLICATIONS

Aug. 30, 2010 Office Action issued in Chinese Patent Application No. 200780004944.4 (with translation).

*Primary Examiner* — Lindsay Low
*Assistant Examiner* — Syed O Hasan
(74) *Attorney, Agent, or Firm* — Oliff PLC

(57) ABSTRACT

A cylinder block side drain is provided in a cylinder block and a crankcase side drain is provided in a crankcase. A jacket cover is provided in an water jacket of the cylinder block. The jacket cover is pressed against the wall of the water jacket on the crankcase side. When discharging the coolant, the water jacket is opened by pushing the jacket cover inward using a coupler and the coolant is discharged to the outer side of the crankcase via the coupler.

2 Claims, 9 Drawing Sheets

(56) References Cited

U.S. PATENT DOCUMENTS

| | | | | |
|---|---|---|---|---|
| 2,153,702 | A * | 4/1939 | Tighe | 411/378 |
| 4,689,028 | A * | 8/1987 | Murase | 440/88 R |
| 5,103,878 | A | 4/1992 | Cassia | |
| 5,404,847 | A | 4/1995 | Han | |
| 6,715,454 | B2 * | 4/2004 | Yonezawa | 123/41.72 |
| 7,036,468 | B2 * | 5/2006 | Kamiyama | 123/78 R |
| 7,360,506 | B2 * | 4/2008 | Shellenberger et al. | 122/13.01 |
| 7,469,662 | B2 * | 12/2008 | Thomas | 123/43 A |
| 2001/0003692 | A1 | 6/2001 | Nakata et al. | |
| 2003/0024491 | A1 * | 2/2003 | Kinomoto et al. | 123/41.14 |
| 2006/0196476 | A1 * | 9/2006 | Stockner | 123/457 |

FOREIGN PATENT DOCUMENTS

| | | |
|---|---|---|
| GB | 299222 | 10/1928 |
| JP | U-59-133729 | 9/1984 |
| JP | A-60-022030 | 2/1985 |
| JP | A 2003-206771 | 7/2003 |
| JP | A 2003-239743 | 8/2003 |
| WO | WO 94/28345 A1 | 12/1994 |
| WO | WO 97/36096 A1 | 10/1997 |

* cited by examiner

VARIABLE COMPRESSION RATIO INTERNAL COMBUSTION ENGINE AND METHOD FOR DISCHARGING COOLANT FROM VARIABLE COMPRESSION RATIO INTERNAL COMBUSTION ENGINE

BACKGROUND OF THE INVENTION

1. Field of the Invention

The invention relates to a variable compression ratio internal combustion engine that varies its compression ratio, and in particular to a drain structure for discharging coolant from a variable compression ratio internal combustion engine and a method for discharging coolant from a variable compression ratio internal combustion engine.

2. Description of the Related Art

In recent years, for the purpose of improving the fuel economy and the output performance of an internal combustion engine, technologies for variably controlling the compression ratio of an internal combustion engine have been proposed. One of such technologies is described in Japanese Patent Application Publication No. JP-A-2003-206771. In an internal combustion engine recited in this publication, the cylinder block and the crankcase are connected to each other such that the cylinder block can be moved relative to the crankcase and a camshaft is provided at the connecting portion between the cylinder block and the crankcase. As the camshaft is rotated, the cylinder block is moved relative to the crankcase in the axial direction of the engine cylinder, so that the capacity of the combustion chamber changes and thus the compression ratio of the internal combustion engine varies.

When manufacturing a variable compression ratio internal combustion engine configured as described above, after the engine bench test in pre-shipment inspection, it is often the case that the engine coolant that has been used in the engine bench test is discharged from the engine in order to prevent corrosion of the cylinder block of the engine. Also, in some maintenance work for such a variable compression ratio internal combustion engine, the coolant is discharged from the engine.

However, the above-described variable compression ratio internal combustion engine in which the relative positions of the cylinder block and the crankcase are changed to vary the compression ratio is often configured such that the cylinder block is moved relative to the crankcase with a portion of the cylinder block being received in a receiving portion that is formed as a portion of the crankcase. In this structure, the outer wall of the cylinder block is covered by the outer wall of the receiving portion of the crankcase. Thus, if a drain hole for connecting the water jacket and the outer side of the cylinder block is simply formed, the coolant may not be guided to the outer side of the crankcase, that is, the coolant may not be appropriately discharged.

SUMMARY OF THE INVENTION

The invention provides a technology that enables coolant to be appropriately discharged from an water jacket formed in the cylinder block of a variable compression ratio internal combustion engine in which the cylinder block is moved relative to the crankcase with a portion of the cylinder block being received in the receiving portion of the crankcase.

A first aspect of the invention relates to a variable compression ratio internal combustion engine having a crankcase in which a crankshaft of the internal combustion engine is mounted and a cylinder block in which a cylinder and an water jacket for coolant are formed, the crankcase having a receiving portion in which the cylinder block is received so as to be slidable in the axial direction of the cylinder. The cylinder block and the crankcase are moved relative to each other, with at least a portion of the cylinder block being received in the receiving portion, to change the capacity of the combustion chamber and thus vary the compression ratio of the internal combustion engine. The internal combustion engine has a drain passage which is provided in the cylinder block and via which the water jacket communicates with the outer side of the cylinder block, and an exposing portion which is provided in the crankcase and through which the opening of the drain passage on the outer side of the cylinder block is exposed so as to enable the coolant to be discharged from the internal combustion engine at least when the compression ratio of the internal combustion engine is equal to a predetermined compression ratio.

Thus, the first aspect of the invention relates to a variable compression ratio internal combustion engine in which the relative positions of a crankcase and a cylinder block are changed with at least a portion of the cylinder block being received in a receiving portion formed at the crankcase. According to the first aspect of the invention, even if the above-described variable compression ratio internal combustion engine is structured such that the opening of the drain passage on the outer side of the cylinder block is covered by the wall of the receiving portion of the crankcase, the opening can be exposed to the outside at least when the compression ratio is equal to the predetermined compression ratio. Therefore, the coolant can be easily discharged from the crankcase, that is, the coolant can be appropriately discharged from the internal combustion engine.

Further, the variable compression ratio internal combustion engine according to the first aspect of the invention may be such that the exposing portion is a drain hole which is formed in the crankcase and through which the inner side of the receiving portion and the outer side of the crankcase communicate with each other.

According to this structure, because the drain hole, which is a passage like the drain passage recited above, is formed in the crankcase, the coolant is first discharged from the water jacket to the outer side of the cylinder block via the drain passage and then to the outer side of the crankcase via the drain hole. Owing to these two passages, it is possible to discharge the coolant to the outer side of the crankcase in a simple manner. Also, because it is not necessary to have a large opening in the receiving portion of the crankcase, the lubricant between the cylinder block and the crankcase is prevented from leaking through the exposing portion.

Further, the variable compression ratio internal combustion engine according to the first aspect of the invention may be such that: the drain passage is formed substantially perpendicular to the axis of the cylinder in the cylinder block; the exposing portion is a drain hole which is formed substantially parallel to the drain passage and through which the inner side of the receiving portion and the outer side of the crankcase communicate with each other; and the variable compression ratio internal combustion engine includes a first cover member that closes the drain hole from the outer side of the crankcase and a seal member which is provided in the gap between an outer wall of the cylinder block and an inner wall of the receiving portion and by which the space between the drain passage and the drain hole is separated from other space between the outer wall of the cylinder block and the inner wall of the receiving portion.

According to the structure described above, the water jacket and the outer side of the cylinder block communicate with each other via the drain passage, the inner side of the receiving portion and the outer side of the crankcase communicate with each other via the drain hole, and the drain passage and the drain hole communicate with each other through the space defined by the seal member, the outer wall of the cylinder block, and the inner wall of the receiving portion of the crankcase. Thus, the coolant passage is formed from the water jacket to the outer side of the crankcase, and therefore the coolant can be easily discharged to the outer side of the crankcase.

In the variable compression ratio internal combustion engine described above, the seal member may be a circular O-ring. Further, the O-ring may be attached to the inner wall of the receiving portion of the crankcase. Also, the inner diameter of the O-ring may be larger than the maximum distance that the cylinder block is moved relative to the crankcase within the variation range of the compression ratio of the internal combustion engine, so that the outer opening of the drain passage is located in the inside of the O-ring at any compression ratio of the internal combustion engine in the variation range. According to this structure, the coolant passage from the water jacket to the outer side of the crankcase can be maintained at any compression ratio of the internal combustion engine in the variation range.

Further, the variable compression ratio internal combustion engine described above may be such that the O-ring is attached to the wall of the cylinder block on the receiving portion side and the opening of the drain passage is located in the inside of the O-ring. That is, a smaller diameter O-ring may be attached to the outer wall of the cylinder block such that the outer opening of the drain passage is located in the inside of the O-ring. In this case, the O-ring is moved together with the cylinder block relative to the crankcase, and therefore the drain passage and the drain hole are placed in communication with each other at the predetermined compression ratio and the communication between the drain passage and the drain hole is shut off at other compression ratios. Thus, the coolant is prevented from leaking from the water jacket to the outside of the O-ring.

Further, the variable compression ratio internal combustion engine according to the first aspect of the invention may be such that: the exposing portion is a drain hole which is provided in the crankcase and via which the inner side of the receiving portion and the outer side of the crankcase communicate with each other; and the internal combustion engine further includes (i) a flexible passage member which can expand and contract or can deform and via which the drain passage and the drain hole communicate with each other at any compression ratio in a variation range of the compression ratio of the internal combustion engine and (ii) a second cover member that closes the drain hole from the outer side of the crankcase.

According to the structure described above, the water jacket and the outer side of the crankcase can be reliably placed in communication with each other at any compression ratio of the internal combustion engine in its variation range, that is, regardless of the position of the cylinder block relative to the crankcase. Then, by opening the drain passage by removing the second cover member therefrom, the coolant can be appropriately discharged from the water jacket to the outer side of the crankcase.

Further, the variable compression ratio internal combustion engine according to the first aspect of the invention may be such that: the drain passage is formed substantially perpendicular to the axis of the cylinder in the cylinder block; the exposing portion is a drain region which is provided in the crankcase and via which the opening of the drain passage on the outer side of the cylinder block is exposed, at any compression ratio in the variation range of the compression ratio of the internal combustion engine, such that the coolant can be discharged from the internal combustion engine; and the internal combustion engine further includes a third cover member that closes the drain passage from the outer side of the crankcase.

According to the structure described above, the drain region is formed such that the opening of the drain passage on the outer side of the cylinder block is exposed to the outer side of the crankcase at any position of the same opening that changes relative to the crankcase in response to the compression ratio of the internal combustion engine being varied. For example, the drain region may be a hole having an elongated cross-sectional shape.

Further, in the structure described above, the drain passage is closed by the third cover member that is detachable from the outer side of the drain region. Therefore, the coolant can be discharged by simply removing the third cover member from the outer side of the drain region. Thus, the procedure for discharging the coolant can be simplified. As such, it is possible to simplify the structure for discharging the coolant from the water jacket to the outer side of the crankcase.

Further, the variable compression ratio internal combustion engine described above may further include a fourth cover member that closes the drain region from the outside. That is, the opening of the drain passage on the outer side of the cylinder block is exposed as viewed from the outer side of the drain region, and the third cover member is attached to the opening from the outer side of the drain region. In this state, further, the fourth cover member that covers the drain region entirely may be attached to close the drain region entirely.

According to this structure, the lubricant between the cylinder block and the crankcase is prevented from leaking through the drain region.

Further, the variable compression ratio internal combustion engine according to the first aspect of the invention may be such that: the drain passage is formed substantially perpendicular to the axis of the cylinder in the cylinder block; the exposing portion is a drain region which is provided in the crankcase and via which the opening of the drain passage on the outer side of the cylinder block is exposed, at any compression ratio in the variation range of the compression ratio of the internal combustion engine, such that the coolant can be discharged from the internal combustion engine; and the internal combustion engine further includes (i) a connection passage member that extends through the drain region, a first end of the connection passage member being connected to the opening of the drain passage on the outer side of the cylinder block and a second end of the connection passage member being located on the outer side of the drain region and (ii) a fifth cover member that closes the opening at the second end of the connection passage member from the outer side of the crankcase.

According to the structure described above, the drain region is formed such that the opening of the drain passage on the outer side of the cylinder block is exposed to the outer side of the crankcase at any position of the same opening. As mentioned above, the drain region may be a hole having an elongated cross sectional shape. The connection passage member is connected to the drain passage via the drain region. The opening of the connection passage member is located in the outer side of the crankcase. Thus, the coolant can be reliably discharged from the water jacket to the outer side of the crankcase via the connection passage member. Also, when the coolant is not discharged, leaks of the coolant can be prevented by simply attaching the fifth cover member to the opening of the connection passage member.

Further, the variable compression ratio internal combustion engine described above may further include a flexible member that fills the gap around the connection passage member in the drain region. According to this structure, the drain region can be hermetically closed at any compression ratio of the internal combustion engine in the variation range.

That is, according to the structure described above, when the position of the connection passage member changes in the drain region in response to the compression ratio being varied, the flexible member deforms accordingly, so that the drain region remains hermetically closed. As such, the lubricant between the cylinder block and the crankcase can be more reliably prevented from leaking through the drain region.

Further, the variable compression ratio internal combustion engine according to the first aspect of the invention may further include (i) a sixth cover member which is provided in the drain passage and which closes the opening of the drain passage on the water jacket side by being pressed at a predetermined pressure against the same opening from the water jacket, and (ii) a seventh cover member that closes the exposing portion from the outer side of the crankcase.

Further, when discharging the coolant from the variable compression ratio internal combustion engine described above, a method may be used which includes: removing the seventh cover member from the exposing portion; inserting a discharge member into the exposing portion, the discharge member having a first end portion into which the coolant is drawn and a second end portion from which the coolant is discharged; opening the opening of the drain passage by moving the sixth cover member by inserting the discharge member into the drain passage against the predetermined pressure; and discharging the coolant from the water jacket to the outer side of the crankcase by drawing the coolant into the first end of the discharge member and then discharging the coolant from the second end of the discharge member.

In the variable compression ratio internal combustion engine described above, the sixth cover member is provided which closes the opening of the drain passage by being pressed from the water jacket side at a predetermined pressure, and therefore the water jacket is automatically closed.

In the discharging method descried above, the discharge member is used as a tool for discharging the coolant. The coolant is drawn into the first end of the discharge member and discharged from the second end. When discharging the coolant, the discharge member is inserted into the exposing portion, which is a passage, and then into the drain passage. Then, the sixth cover member is pushed to open against the predetermined pressure, so that the coolant is drawn into the first end of the discharge member and discharged from the second end to the outer side of the crankcase.

According to the discharging method described above, the coolant can be automatically discharged to the outside by simply inserting the discharge member into the exposing portion and then pressing it toward the water jacket side.

Further, the above-described variable compression ratio internal combustion engine and the above-described discharging method may be such that: the drain passage is formed substantially perpendicular to the axis of the cylinder in the cylinder block; the exposing portion may be a drain hole which is formed substantially parallel to the drain passage and via which the inner side of the receiving portion and the outer side of the crankcase communicate with each other; and the drain passage and the drain hole are aligned substantially coaxially with each other when the compression ratio of the internal combustion engine is equal to the predetermined compression ratio.

According to the engine structure and the discharging method described above, the drain passage and the drain hole are both formed substantially perpendicular to the axis of the cylinder in the cylinder block, and the drain passage and the drain hole are aligned substantially coaxially with each other when the compression ratio of the internal combustion engine is equal to the predetermined compression ratio. When discharging the coolant from the variable compression ratio internal combustion engine structured as described above, the drain passage and the drain hole are aligned substantially coaxially with each other, and then the discharge member is inserted into the drain passage. As such, the cross-sectional area of the exposing portion in the crankcase can be reduced, and the lubricant between the cylinder block and the crankcase can be prevented from leaking through the exposing portion.

The engine structure and the discharging method described above may be such that: the drain passage is formed substantially parallel to the axis of the cylinder in the cylinder block; the exposing portion is a drain hole which is formed substantially parallel to the drain passage and via which the inner side of the receiving portion and the outer side of the crankcase communicate with each other, and the drain passage and the drain hole are aligned substantially coaxially with each other when the compression ratio of the internal combustion engine is equal to the predetermined compression ratio.

That is, in the above case, the drain passage and the drain hole are formed parallel to the axis of the cylinder such that, for example, the drain passage extends from the bottom side of the water jacket to the bottom side of the cylinder block and the drain hole extends from the bottom side of the receiving portion of the crankcase to the bottom side of the crankcase. As such, the drain passage and the drain hole are always coaxial with each other regardless of the compression ratio of the internal combustion engine, and therefore the coolant can be discharged at any compression ratio of the internal combustion engine.

Further, in the variable compression ratio internal combustion engine according to the first aspect of the invention, the drain passage may be formed in a portion of the cylinder block that is not received in the receiving portion and extends substantially perpendicular to the axis of the cylinder.

Further, when discharging the coolant from the variable compression ratio internal combustion engine described above, a method may be used which includes: inserting a flexible drain tube into the drain passage; further inserting the drain tube so that a first end of the drain tube reaches near the bottom of the water jacket, and then discharging the coolant to the outside by drawing it out from a second end of the drain tube.

According to the variable compression ratio internal combustion engine described above, the drain passage is formed in the portion of the cylinder block that is not received in the receiving portion of the crankcase. In this case, the opening of the drain passage is not covered by the crankcase, that is, the opening of the drain passage is always exposed to the outer side of the crankcase. However, when the drain passage is arranged as above, the upper area of the water jacket in the cylinder block and the outer side of the cylinder block communicate through the drain passage, and therefore it is difficult to discharge the coolant sufficiently.

To cope with this, a drain tube is inserted into the drain passage so that the first end of the drain tube reaches the bottom of the water jacket and the coolant is then drawn out from the second end of the drain tube using a pump, or the like.

In this way, the coolant can be discharged at any compression ratio of the internal combustion engine in the variation range in a very simple manner and with a very simple structure.

The variable compression ratio internal combustion engine described above may further include a drain pipe which extends through the drain passage and a first end of which is located at the bottom of the water jacket, and a drain plug that closes a second end of the drain pipe.

When discharging the coolant from the variable compression ratio internal combustion engine described above, a method may be used which includes: removing the drain plug; and discharging the coolant from the second end of the drain pipe using a pump, or the like. According to this method, the coolant can be easily discharged.

Note that the components, methods, and means that are incorporated in the invention to achieve the objects of the invention may be combined as much as possible.

As such, according to the invention, in a variable compression ratio internal combustion engine in which a cylinder block is received in a receiving portion of the crankcase and the cylinder block is moved relative to the crankcase, the coolant can be appropriately discharged from an water jacket formed in the cylinder block.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF THE EXEMPLARY EMBODIMENTS

Hereinafter, exemplary embodiments of the invention will be described in detail with reference to the drawings.

Figure 1:
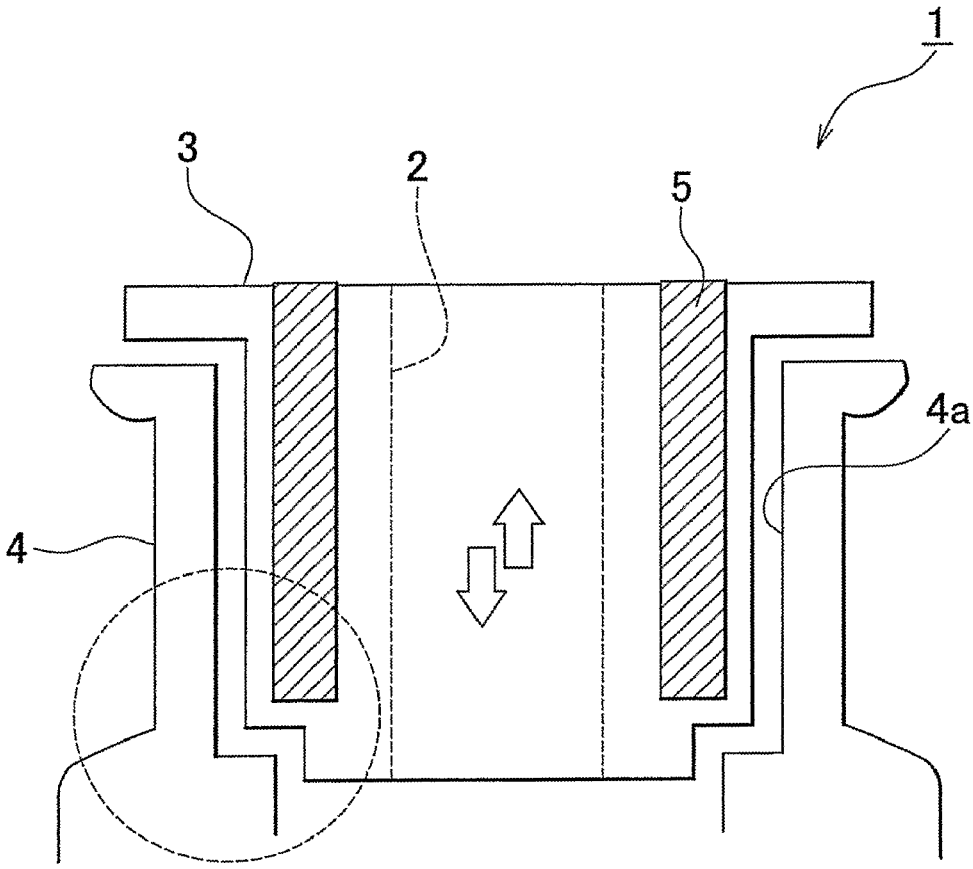
FIG. 1 is a view schematically showing the structure of an internal combustion engine according to an exemplary embodiment of the invention.

FIG. 1 schematically shows a cylinder block 3 and a crankcase 4 of a variable compression ratio internal combustion engine 1 (will be simply referred to as "internal combustion engine 1") according to the exemplary embodiment of the invention. Referring to FIG. 1, the cylinder block 3 and the crankcase 4 are separate from each other. A cylinder 2 and an water jacket 5 that is a coolant passage are formed in the cylinder block 3. A cylinder head, which is not shown in the drawing, is provided on the cylinder block 3. In the crankcase 4, a crank shaft, a connecting rod, and a piston, which are not shown in the drawing, are provided.

The crankcase 4 has a receiving portion 4*a* that receives the cylinder block 3. When varying the compression ratio of the internal combustion engine 1, a variable compression ratio mechanism, which is not shown in the drawing, moves the cylinder block 3 toward or away from the crankcase 4 in the axial direction of the cylinder 2. As the cylinder block 3 is thus moved relative to the crankcase 4, the capacity of the combustion chamber changes, so that the compression ratio changes accordingly.

In the case of a normal internal combustion engine in which the cylinder block can not be moved relative to the crankcase, a drain is formed in the cylinder block. This drain extends from a portion near the bottom of the water jacket in the cylinder block to the outer side of the cylinder block. The drain is normally closed by a drain plug. During an engine bench check in the factory or during maintenance work in market, the drain plug is removed to discharge the coolant from the water jacket via the drain.

However, in the internal combustion engine 1 structured as shown in FIG. 1, because the inner walls of the receiving portion 4*a* are present on the outer side of the cylinder block 3, and the cylinder block 3 is moved relative to the inner walls of the receiving portion 4*a* as required to achieve the target compression ratio, it is sometimes difficult to discharge the coolant from the water jacket 5 to the outer side of the crankcase 4 directly.

The first exemplary embodiment of the invention will be described. To cope with this, in the first exemplary embodiment, a cylinder block side drain 3*a* is provided in the cylinder block 3 and a crankcase side drain 4*b* is provided in the crankcase 4. An O-ring 50 is interposed between the cylinder block side drain 3*a* and the crankcase side drain 4*b* such that the cylinder block side drain 3*a* and the crankcase side drain 4*b* communicate with each other via the O-ring 50. Note that the views of FIG. 2 to FIG. 7 are enlarged views of the portion indicated by the dotted circle in FIG. 1.

Figure 2B:
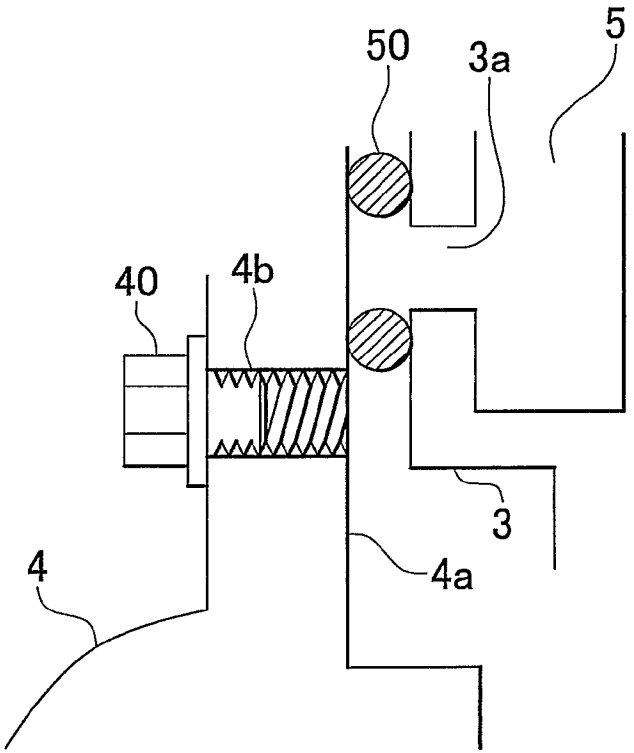
FIG. 2A and FIG. 2B are cross-sectional views schematically showing an water jacket drain structure according to the first exemplary embodiment of the invention.
Figure 2A:
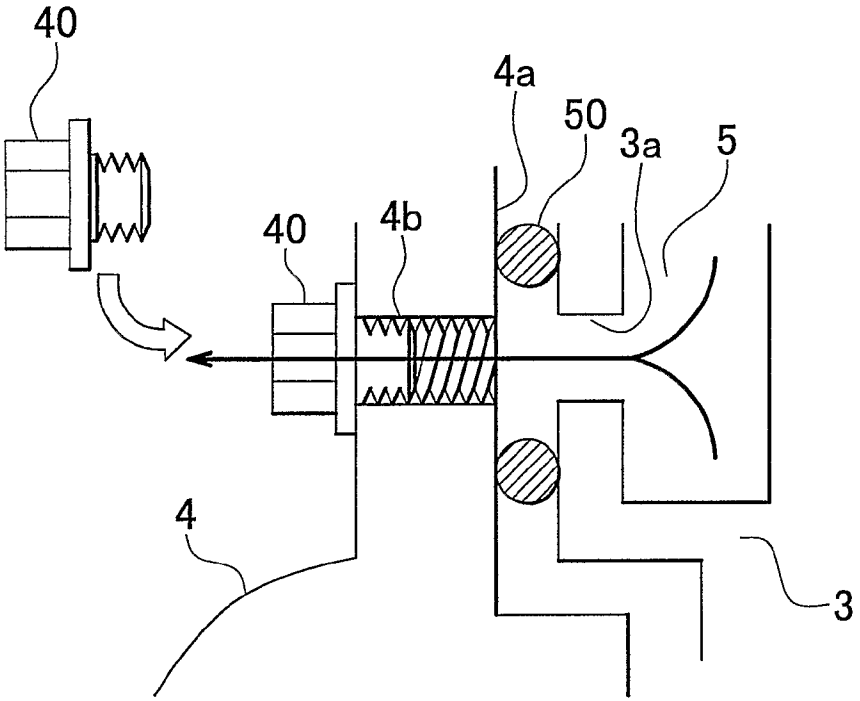

FIG. 2A and FIG. 2B schematically show drain structures according to the first exemplary embodiment. In the example shown in FIG. 2A, the cylinder block side drain 3*a* is formed in the cylinder block. The cylinder block side drain 3*a* extends from the water jacket 5 to the outer side of the cylinder block 3. The crankcase side drain 4*b* is formed in the crankcase 4. The cylinder block side drain 3*a* and the crankcase side drain 4*b* are aligned coaxially with each other when the compression ratio of the internal combustion engine 1 is at the highest level and the cylinder block 3 is therefore located at the position proximal to the crankcase 4. The inner wall of the crankcase side drain 4*b* is threaded.

The crankcase side drain 4*b* is normally closed by the drain plug 40 that is screwed into the opening of the crankcase side drain 4*b* on the outer side of the crankcase 4.

In the first exemplary embodiment, the O-ring 50 is provided between the cylinder block 3 and the crankcase 4 as described above. The O-ring 50 is attached to the inner wall of the receiving portion 4*a* of the crankcase 4. Therefore, the position of the O-ring 50 does not change relative to the crankcase 4 when the cylinder block 3 is moved relative to the crankcase 4. The inner diameter of the O-ring 50 is large enough for the opening of the cylinder block side drain 3*a* on the outer side of the cylinder block 3 to be always present in the inside of the O-ring 50 even when the compression ratio of the internal combustion engine 1 is at the highest level of its variation range and even when the compression ratio is at the lowest level. That is, the cylinder block side drain 3*a* and the crankcase side drain 4*b* communicate with each other through the space defined by the O-ring 50 in the gap between the cylinder block 3 and the crankcase 4.

When discharging the coolant from the water jacket 5, the drain plug 40 is removed, so that the coolant is discharged from the water jacket 5 to the outside via the cylinder block side drain 3*a*, the space defined by the O-ring 50 in the gap between the cylinder block 3 and the crankcase 4, and the crankcase side drain 4*b*.

As such, according to the first exemplary embodiment, the coolant can be discharged from the water jacket 5 in a very simple manner, and the structure for discharging the coolant is also very simple.

In the first exemplary embodiment, a relatively large O-ring is used as the O-ring 50 so that the opening of the cylinder block side drain 3*a* on the outer side of the cylinder block 3 is located in the inside of the O-ring 50 at any compression ratio in the variation range. However, a smaller O-ring may alternatively be used as the O-ring 50 and the O-ring 50 may be attached to the cylinder block 3 such that the opening of the cylinder block side drain 3*a* on the outer side of the cylinder block 3 is located in the inside of the O-ring 50.

According to this structure, when the cylinder block side drain 3*a* and the crankcase side drain 4*b* are aligned coaxially with each other, the cylinder block side drain 3*a* and the crankcase side drain 4*b* are placed in communication with each other through the space defined by the O-ring 50 in the gap between the cylinder block 3 and the crankcase 4, making it possible to discharge the coolant from the water jacket 5. As mentioned above, the cylinder block side drain 3*a* and the crankcase side drain 4*b* are aligned coaxially with each other when the compression ratio is at the highest level and the cylinder block 3 is therefore located at the position proximal to the crankcase 4.

If the compression ratio is set to, for example, a level close to the lowest level of the variation range, the O-ring 50 is then moved relative to the crankcase 4 together with the cylinder block 3, so that the crankcase side drain 4*b* is placed in communication with the space on the outer side of the O-ring 50. In this state, the water jacket 5 is normally closed hermetically by the O-ring 50 and the inner wall of the receiving portion 4*a*.

In the structure described above, the cylinder block side drain 3*a* corresponds to "drain passage", the crankcase side drain 4*b* corresponds to "drain hole", the drain plug 40 corresponds to "first cover member", and the O-ring 50 corresponds to "seal member".

Next, the second exemplary embodiment of the invention will be described. In the second exemplary embodiment, the drain in the cylinder block and the drain in the crankcase are connected to each other through a flexible pleated tube to enable the coolant to be discharged at any compression ratio of the internal combustion engine.

Figure 3A:
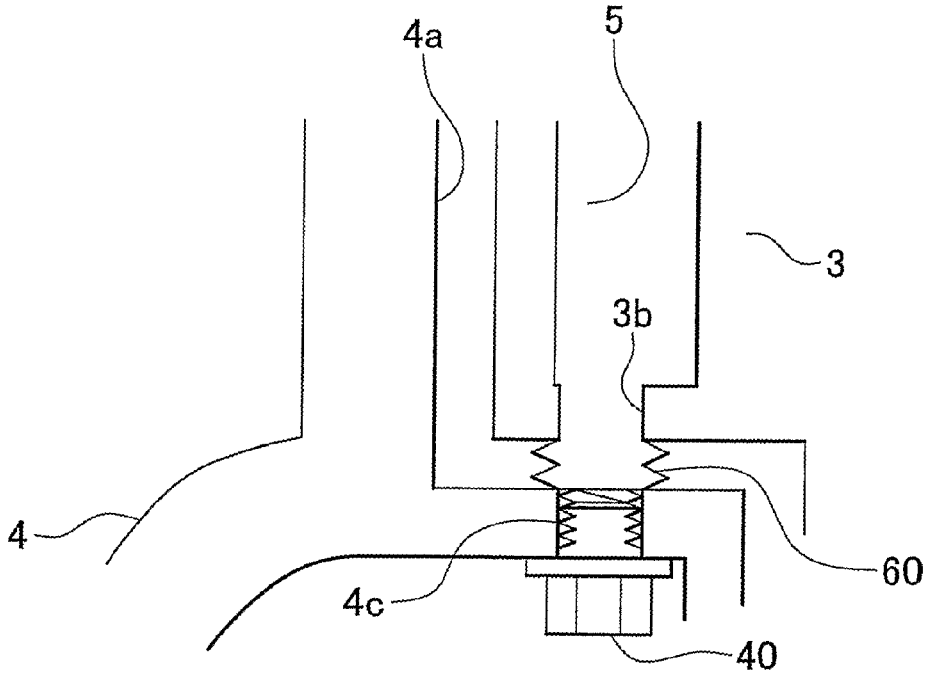
FIG. 3A and FIG. 3B are cross-sectional views schematically showing water jacket drain structures according to the second exemplary embodiment of the invention.
Figure 3B:
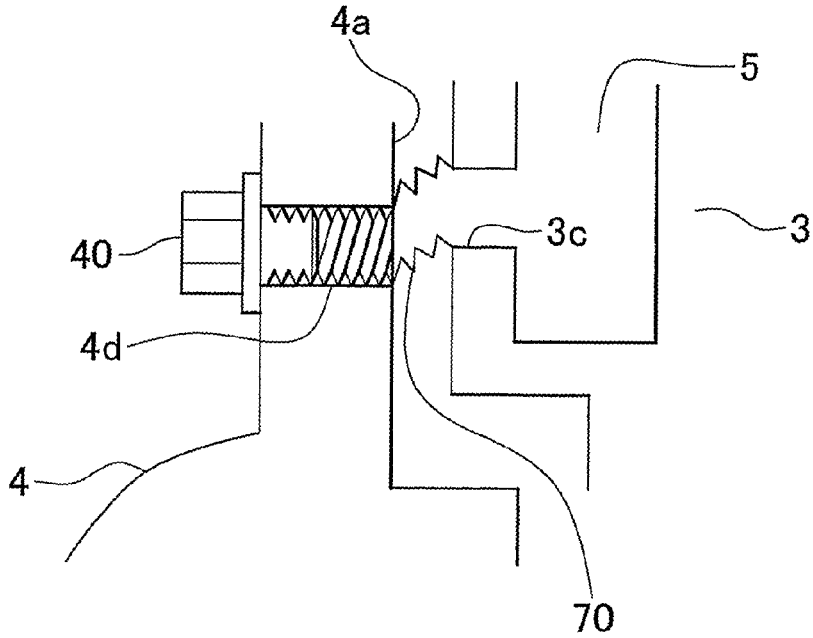

FIG. 3A and FIG. 3B are views schematically showing drain structures according to the second exemplary embodiment. In the example shown in FIG. 3A, a cylinder block side drain 3*b* and a crankcase side drain 4*c* are formed parallel to the axis of a cylinder 2, and the cylinder block side drain 3*b* and the crankcase side drain 4*c* are connected to each other via a pleated tube 60. The inner wall of the crankcase side drain 4*c* is threaded, and the drain plug 40 is screwed into the crankcase side drain 4*c*, whereby the crankcase side drain 4*c* is closed.

The pleated tube 60 expands and contracts as the cylinder block 3 is moved relative to the crankcase 4 to vary the compression ratio as required, whereby the communication between the cylinder block side drain 3*b* and the crankcase side drain 4*c* is maintained. According to this structure, the communication between the water jacket 5 and the outer side of the crankcase 4 can be maintained at any compression ratio of the internal combustion engine 1 in the variation range, and the coolant can be appropriately discharged by simply removing the drain plug 40.

In the example shown in FIG. 3B, a cylinder block side drain 3*c* and a crankcase side drain 4*d* are formed perpendicular to the axis of the cylinder 2, and the cylinder block side drain 3*c* and the crankcase side drain 4*d* are connected to each other via a pleated tube 70. The cylinder block side drain 3*c* and the crankcase side drain 4*d* are aligned coaxially with each other when the compression ratio of the internal combustion engine 1 is at the highest level (i.e., when the cylinder block 3 is at the position corresponding to the highest compression ratio).

According to the structure described above, the direction in which the cylinder block 3 is moved relative to the crankcase 4 is perpendicular to the direction in which the cylinder block side drain 3*c* and the crankcase side drain 4*d* extend. Therefore, when the compression ratio is at a level other than the highest level, the axis of the cylinder block side drain 3*c* and the axis of the crankcase side drain 4*d* do not coincide with each other. However, even in such a case, because the pleated tube 70 deforms in the direction perpendicular to the axis of the pleated tube 70, the communication between the cylinder block side drain 3*c* and the crankcase side drain 4*d* is maintained. As such, in this example, too, the coolant can be discharged from the water jacket 5 by simply removing drain plug 40.

In the second exemplary embodiment described above, each of the pleated tubes 60, 70 corresponds to "flexible passage member" and the drain plug 40 corresponds to "second cover member".

Next, the third exemplary embodiment of the invention will be described. In the third exemplary embodiment, the inner wall of a cylinder block side drain 3*d* is threaded and the cylinder block side drain 3*d* is normally closed by the drain plug 40, and the opening of the cylinder block side drain 3*d* on the outer side of the cylinder block 3 is exposed to the outer side of the crankcase 4 at any compression ratio of the internal combustion engine 1 in the variation range.

Figure 4:
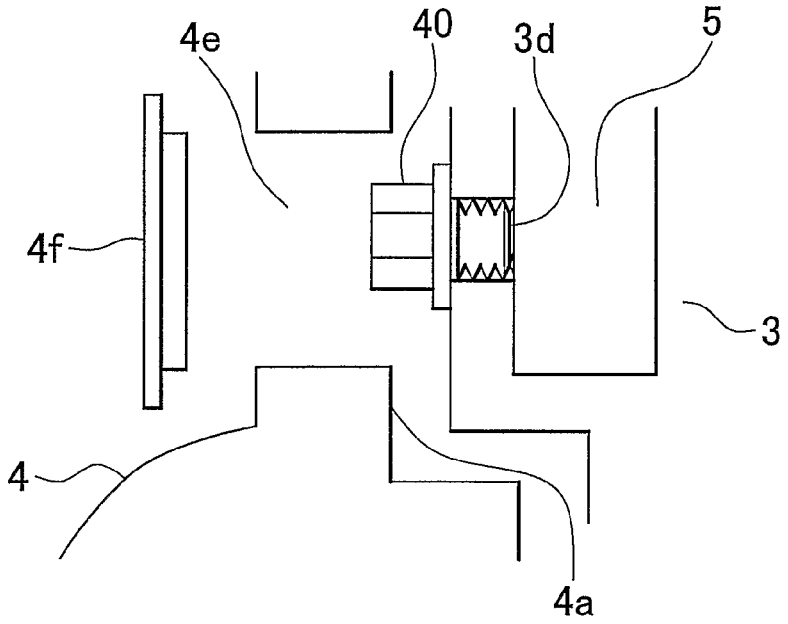
FIG. 4 is a cross-sectional view schematically showing an water jacket drain structure according to the third exemplary embodiment of the invention.

FIG. 4 schematically shows a drain structure according to the third exemplary embodiment. Referring to FIG. 4, the inner wall of the cylinder block side drain 3*d* is threaded, and the cylinder block side drain 3*d* is closed by the drain plug 40 except when discharging the coolant. A crankcase side slit 4*e* is formed in the crankcase 4. The crankcase side slit 4*e* is long enough for the cylinder block side drain 3*d* to be exposed to the outer side of the crankcase 4 through the crankcase side slit 4*e* at any compression ratio of the internal combustion engine 1.

According to this structure, the coolant can be discharged to the outer side of the crankcase 4 by removing the drain plug 40.

As such, the coolant can be discharged at any compression ratio of the internal combustion engine 1 and the structure for discharging the coolant is simpler.

In the structure described above, a cap 4*f* may be provided on the crankcase side slit 4*e* to cover it entirely. In this case, the crankcase side slit 4*e* is entirely closed by the cap 4*f* and therefore the lubricant between the cylinder block 3 and the crankcase 4 is prevented from leaking to the outside.

Figure 5:
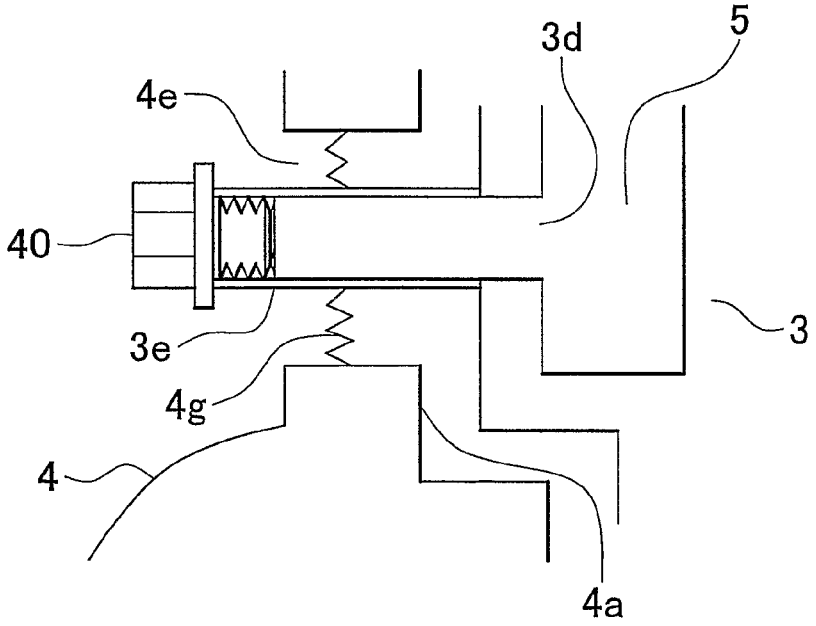
FIG. 5 is a cross-sectional views schematically showing another water jacket drain structure according to the third exemplary embodiment of the invention.

Further, FIG. 5 shows another drain structure according to the third exemplary embodiment. In this example, a connection pipe 3*e* is connected to the cylinder block side drain 3*d* and the outer end of the connection pipe 3*e* is located in the outer side of the crankcase side slit 4*e* and the connection pipe 3*e* is closed by the drain plug 40. According to this structure, the coolant can be discharged to the outer side of the crankcase 4 more reliably.

In the example shown in FIG. 5, further, a pleated cover 4*g*, which is made of flexible material (e.g., rubber), may be provided to fill the gap around the connection pipe 3*e* in the crankcase side slit 4*e*. According to this structure, even if the connection pipe 3*e* moves within the crankcase side slit 4*e* in response to the compression ratio of the internal combustion engine 1 being varied, the crankcase side slit 4*e* is normally closed, and therefore the lubricant between the cylinder block 3 and the crankcase 4 can be prevented from leaking to the outside.

In the third exemplary embodiment described above, the crankcase side slit 4*e* corresponds to "drain region", the drain plug 40 corresponds to "third cover member", the cap 4*f* corresponds to "fourth cover member", the connection pipe 3*e* corresponds to "connection passage member", the drain plug 40 for closing the connection pipe 3*e* corresponds to "fifth cover member", and the pleated cover 4*g* corresponds to "flexible member".

Next, the fourth exemplary embodiment of the invention will be described. In the fourth exemplary embodiment, a cover member is provided in the water jacket of the cylinder block. The cover member is pressed against the inner wall of the water jacket on the crankcase side from the inside of the water jacket. When discharging the coolant, the water jacket is opened by pressing the cover member inward using a coupler and the coolant is then brought to the outer side of the crankcase through the coupler.

Figure 6A:
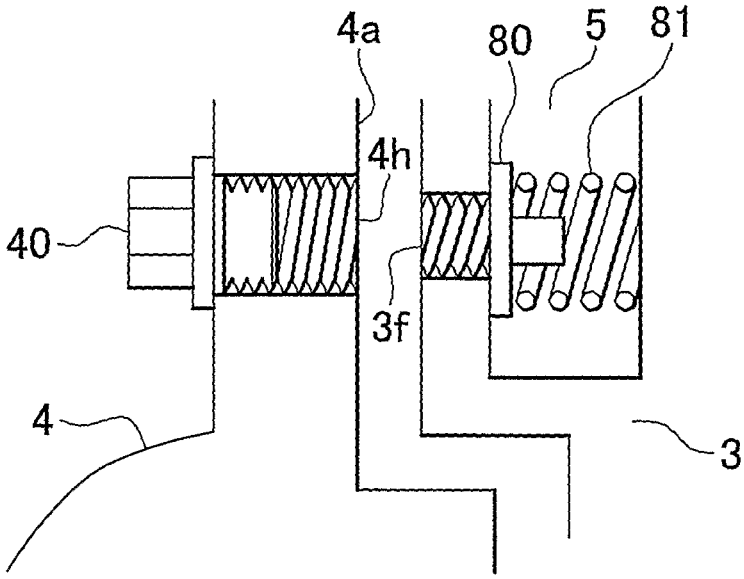
FIG. 6A and FIG. 6B are cross-sectional views for illustrating a method for discharging coolant from an water jacket in the fourth exemplary embodiment of the invention.
Figure 6B:
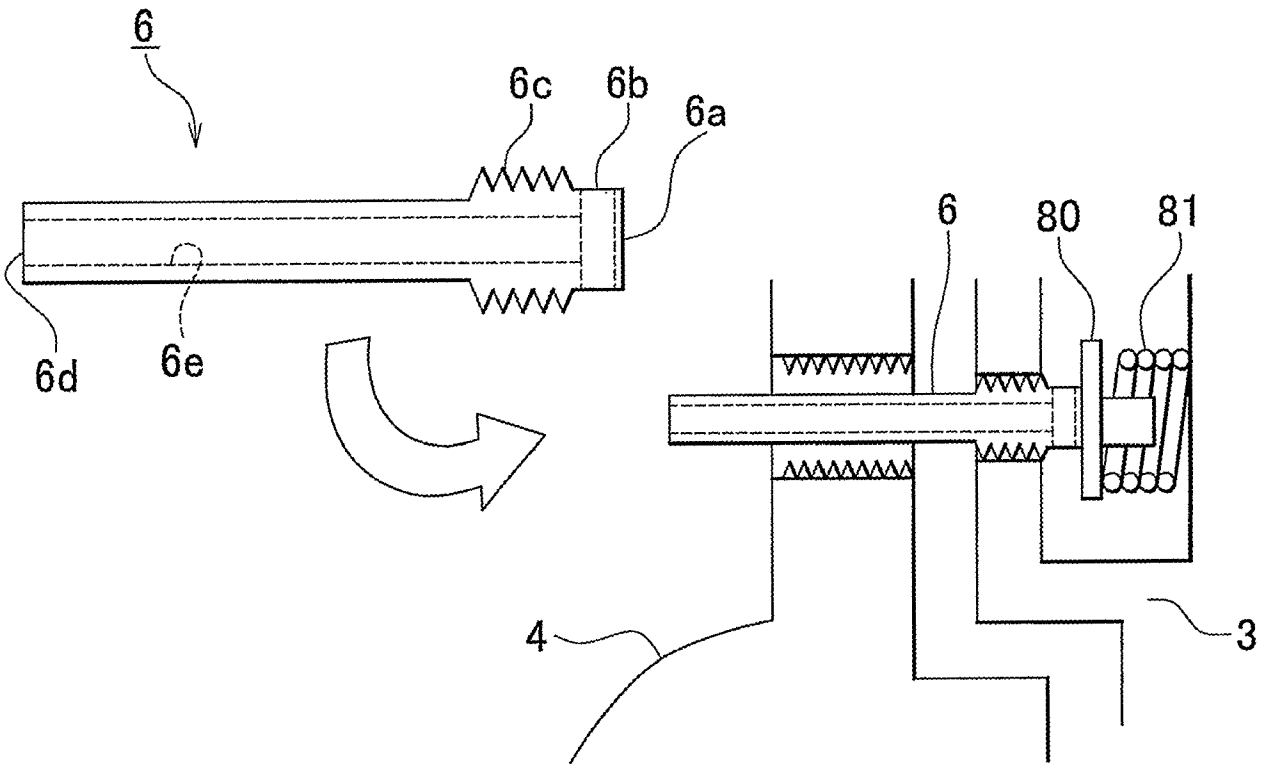

FIG. 6A and 6B schematically show a drain structure according to the fourth exemplary embodiment. Referring to FIG. 6A, a cylinder block side drain 3*f* is formed in the cylinder block 3 and a crankcase side drain 4*h* is formed in the crankcase 4. The cylinder block side drain 3*f* and the crankcase side drain 4*h* are aligned coaxially with each other when the compression ratio of the internal combustion engine 1 is at the highest level and the cylinder block 3 is therefore located at the position proximal to the crankcase 4. The inner walls of the cylinder block side drain 3*f* and the crankcase side drain 4*h* are threaded. The inner diameter of the crankcase side drain 4*h* is larger than the inner diameter of the cylinder block side drain 3*f*.

Referring to FIG. 6A, a jacket cover 80 and an urging spring 81 are provided in the water jacket 5. The urging spring 81 presses the jacket cover 80 against the inner wall of the water jacket 5 on the cylinder block side drain 3*f* side, whereby the water jacket 5 is hermetically closed. The drain plug 40 is screwed into the opening of the crankcase side drain 4*h* on the outer side of the crankcase 4 to close the crankcase side drain 4*h*.

Next, the method for discharging the coolant from the water jacket 5 will be described with reference to FIG. 6B. According to the fourth exemplary embodiment, a coupler 6 is used as a work tool for discharging the coolant. Coolant inlets 6*b* are formed in the side faces of a first end portion 6*a* of the coupler 6. A thread 6*c* is formed on the coupler 6, and a coolant passage 6*e* is formed in the coupler 6. The coolant passage 6*e* extends from the coolant inlets 6*b* to a second end portion 6*d* of the coupler 6. When discharging the coolant, the drain plug 40 is first removed from the crankcase side drain 4*h* and the coupler 6 is then inserted into the opening of the crankcase side drain 4*h*. When the coupler 6 reaches the opening of the cylinder block side drain 3*f*, the coupler 6 is then screwed into the cylinder block side drain 3*f*, pushing the jacket cover 80 inward against the urging force of the urging spring 81, so that the water jacket 5 is opened. Then, the coolant flows through the coolant inlets 6*b* and the coolant passage 6*e* in the coupler 6 and is then discharged to the outer side of the crankcase 4 from the second end portion 6*d*.

According to the fourth exemplary embodiment, as described above, the drains are provided in the cylinder block 3 and the crankcase 4, respectively, and the coolant can be discharged by inserting the coupler 6 into the crankcase side drain 4*h* after setting the compression ratio of the internal combustion engine 1 to the highest level. Thus, the coolant can be more reliably discharged in a simple manner, and the structure for discharging the coolant is also simple.

Figure 7A:
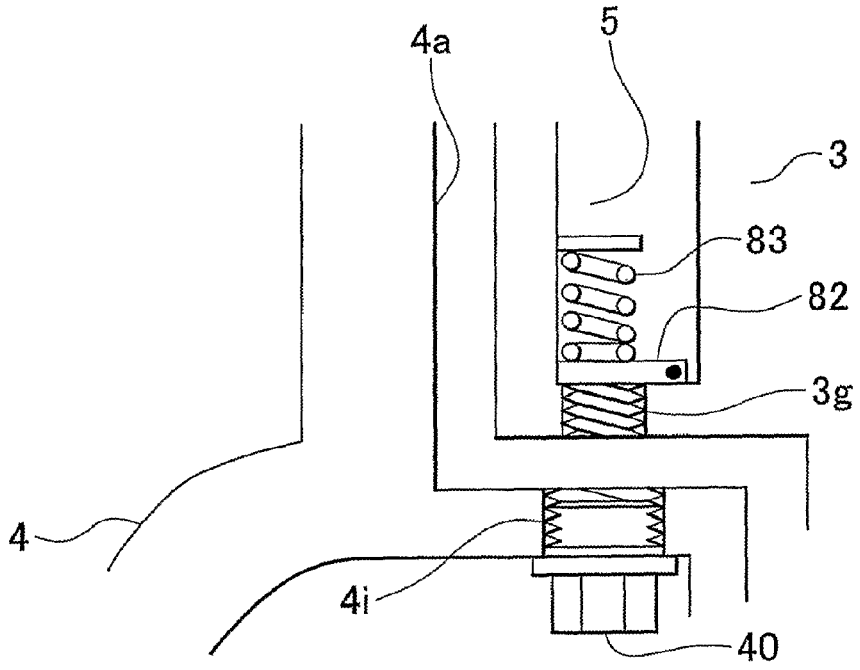
FIG. 7A and FIG. 7B are cross-sectional views for illustrating another method for discharging coolant from an water jacket in the fourth exemplary embodiment of the invention.
Figure 7B:
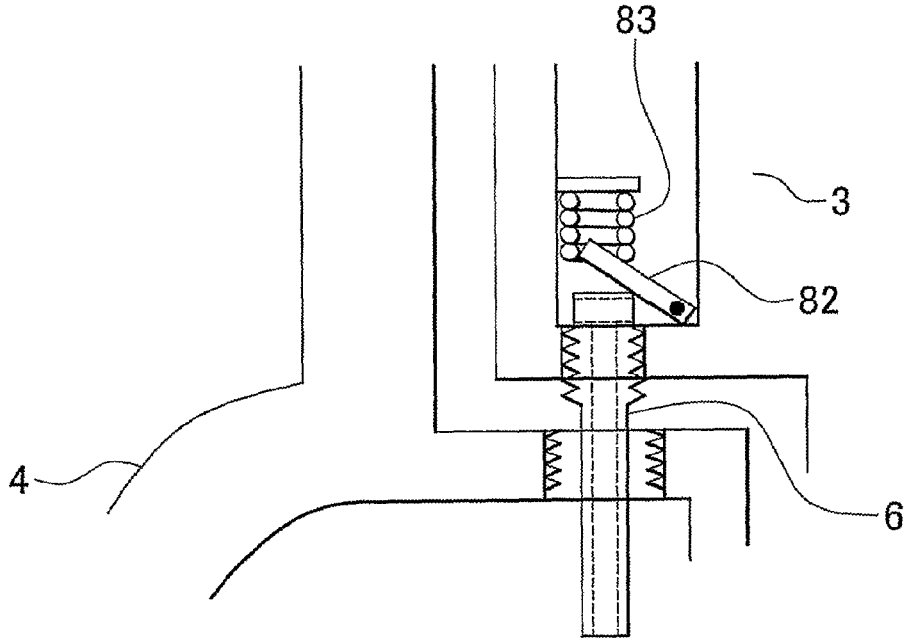

FIG. 7A and FIG. 7B show another drain structure according to the fourth exemplary embodiment. In this example, a cylinder block side drain 3*g* and a crankcase side drain 4*i* are formed parallel to the axis of the cylinder. Referring to FIG. 7A, an water jacket cover 82 is pivotably provided at the bottom of the water jacket 5, and an urging spring 83 urges the water jacket cover 82 downward. When discharging the coolant, the coupler 6 is inserted from below as shown in FIG. 7B. The coupler 6 is long enough to lift up the water jacket cover 82. According to this structure, the coolant can be discharged at any compression ratio of the internal combustion engine 1.

In the fourth exemplary embodiment described above, each of the jacket covers 80, 82 corresponds to "sixth cover member", and the coupler 6 corresponds to "discharge member". Also, in the fourth exemplary embodiment, the thread 6*c* is formed on the coupler 6 and the water jacket 5 is opened by moving the jacket cover 80, 82 by screwing the coupler 6 into the cylinder block side drain 3*f*, 3*g*. However, the thread 6*c* may be omitted if appropriate. For example, the drain structure may be modified such that the water jacket 5 is opened by pushing the jacket cover by inserting a coupler having no thread into the cylinder block side drain.

Next, the fifth exemplary embodiment of the invention will be described. The fifth exemplary embodiment relates to a method for discharging coolant from an internal combustion engine. In the internal combustion engine of the fifth exemplary embodiment, a cylinder block side drain is formed in a portion of the cylinder block that is located in the upper side of the cylinder block and that is not received in the receiving potion of the crankcase at any compression ratio of the internal combustion engine. When discharging coolant from this internal combustion engine, a tube is inserted into the water jacket via the cylinder block side drain and the coolant is then drawn out from the water jacket through the tube.

Figure 8:
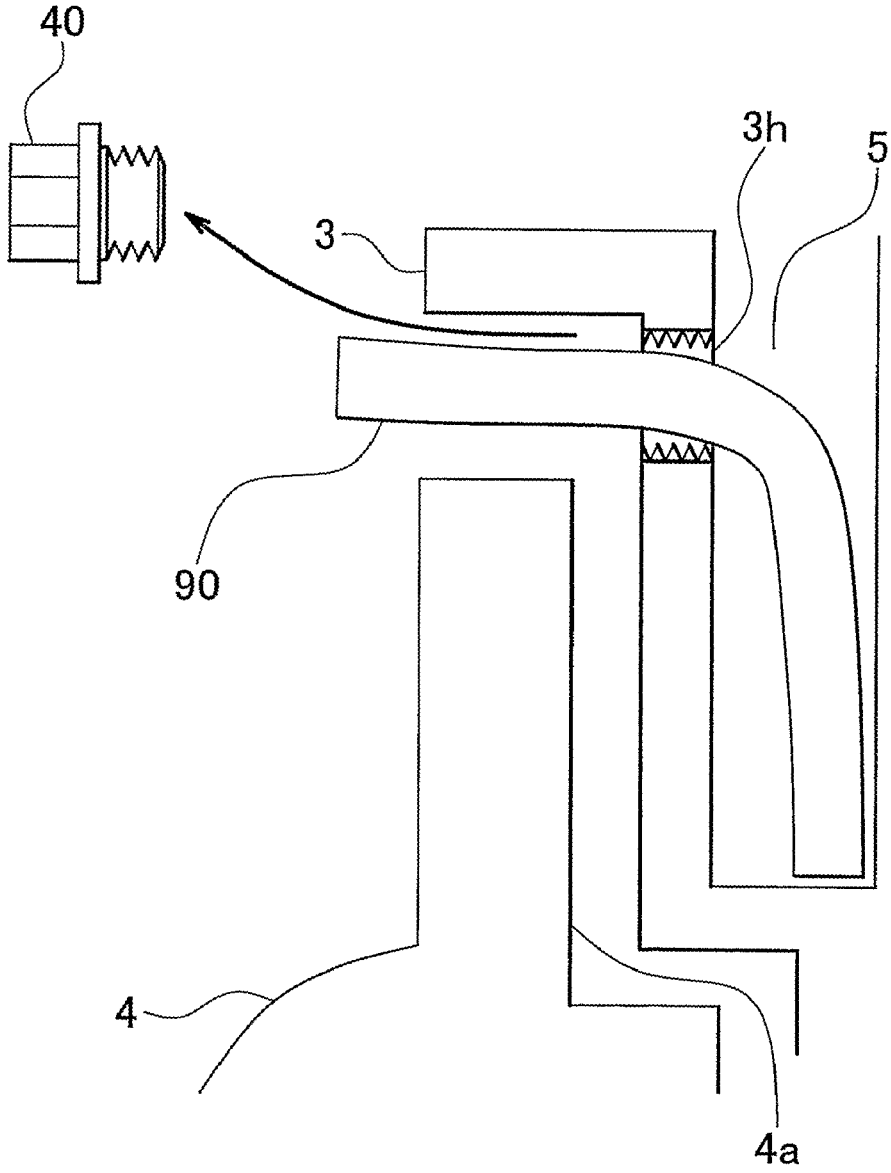
FIG. 8 is a cross-sectional view for illustrating a method for discharging coolant from an water jacket in the fifth exemplary embodiment of the invention.

FIG. 8 shows a drain structure according to the fifth exemplary embodiment. Referring to FIG. 8, a cylinder block drain 3*h* is provided at a relatively high position in the cylinder block 3. This portion of the cylinder block 3 is not covered by the crankcase 4 at any compression ratio of the internal combustion engine 1 in the variation range.

The inner wall of the cylinder block side drain 3*h* is threaded. The cylinder block side drain 3*h* is normally closed by the drain plug 40 excerpt when discharging the coolant. When discharging the coolant from the water jacket 5, the drain plug 40 is removed and a drain tube 90 is inserted into the cylinder block side drain 3*h* and then pushed to near the bottom of the water jacket 5, and the coolant is then discharged from the rear end of the drain tube 90 using a pump.

In this way, the coolant can be discharged from the water jacket 5 in a simpler manner, and the structure for discharging the coolant can be further simplified. Further, because the cylinder block side drain 3*h* is provided in the portion of the cylinder block 3 that is not covered by the crankcase 4 at any compression ratio, it is not necessary to take any measures to prevent leaks of the lubricant between the cylinder block 3 and the crankcase 4. In the fifth exemplary embodiment, the space on the outer side of the opening of the cylinder block 3 that is not occupied by the crankcase 4 at any compression ratio of the internal combustion engine 1 may be regarded as one example of "exposing portion".

Figure 9:
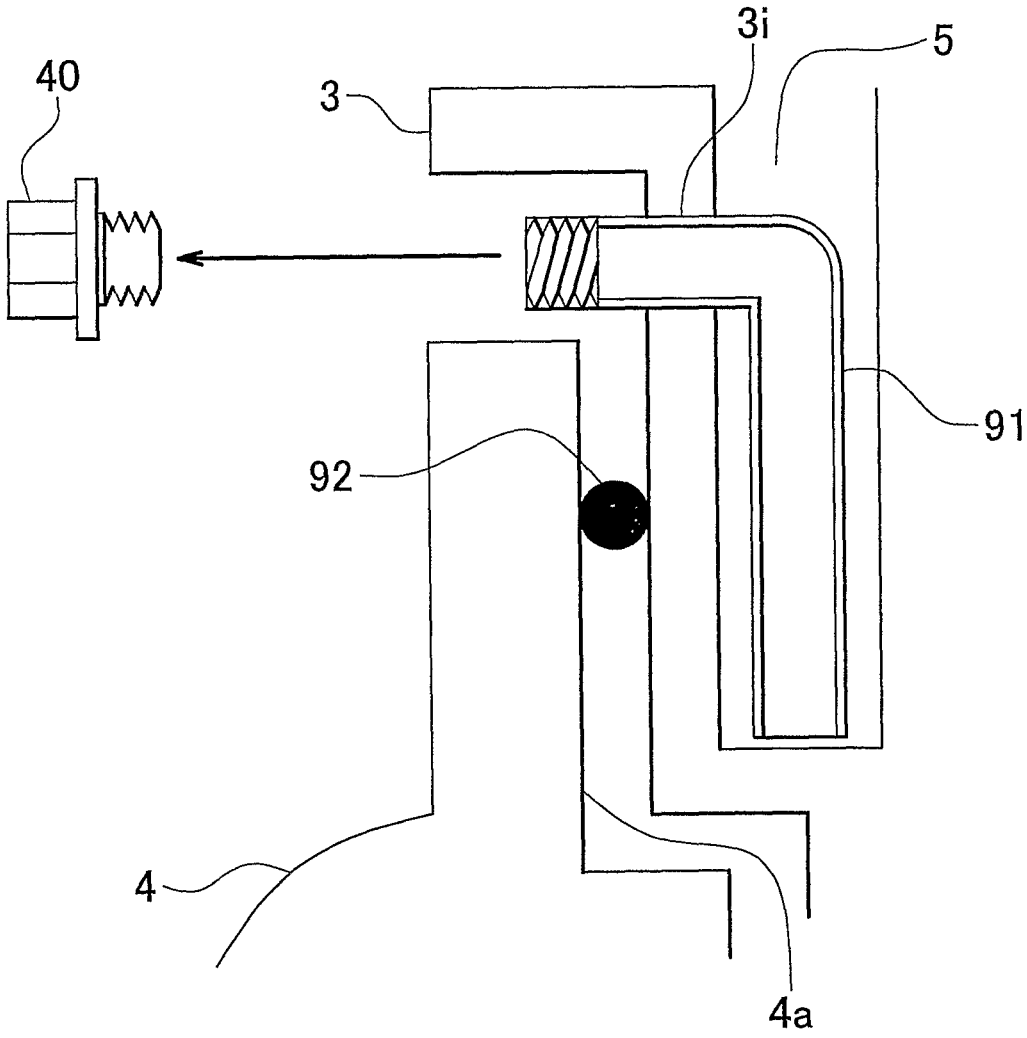
FIG. 9 is a cross-sectional view schematically showing an example of the water jacket drain structure according to the fifth exemplary embodiment of the invention.

FIG. 9 shows another drain structure according to the fifth exemplary embodiment. In this example, too, a cylinder block side drain is provided at an upper portion of the cylinder block that in not received in the receiving portion of the crankcase at any compression ratio.

Referring to FIG. 9, as in the first example described above, a cylinder block side drain 3*i* is provided at a relatively high position in the cylinder block 3, and this portion of the cylinder block 3 is not covered by the crankcase 4 at any compression ratio of the internal combustion engine 1 in the variation range.

In the cylinder block 3, a drain pipe 91 is provided which extends through the cylinder block side drain 3*i* to near the bottom of the water jacket 5. The inner wall of the end portion of the drain pipe 91 on the outer side of the cylinder block 3 is threaded. The drain pipe 91 is normally closed by the drain plug 40 except when discharging the coolant. A seal 92 is provided in the receiving portion 4*a* of the crankcase 4. When discharging the coolant from the water jacket 5, the drain plug 40 is removed and the coolant is then discharged from the outer end portion of the drain pipe 91 using a pump.

Thus, the coolant can be discharged from the water jacket 5 in a simpler manner.

The invention claimed is:

1. A method for discharging a coolant from the variable compression ratio internal combustion engine comprising:

a cylinder block in which a cylinder and a water jacket for coolant are formed;

a crankcase in which a crankshaft of the internal combustion engine is mounted, the crankcase having a receiving portion in which the cylinder block is received so as to be slidable in the axial direction of the cylinder, the cylinder block and the crankcase being moved relative to each other, with at least a portion of the cylinder block being received in the receiving portion, to change the capacity of a combustion chamber and thus vary the compression ratio of the internal combustion engine;

a drain passage which is provided in the cylinder block and via which the water jacket communicates with the outer side of the cylinder block;

a drain hole that is formed in the crankcase and through which the inner side of the crankcase and the outer side of the crankcase communicate with each other;

a member that bridges the gap between the outer wall of the cylinder block and the inner wall of the crankcase to form a coolant passage from the water jacket to the outside of the crankcase so as to enable the coolant to be discharged from the water jacket, at least when the compression ratio of the internal combustion engine is equal to a predetermined compression ratio, through the drain passage, through the inside of the member that bridges the gap and through the drain hole without leaking into the gap;

a first cover member which is provided in the drain passage and which is configured to close the opening of the drain passage on the water jacket side by being pressed at a predetermined pressure against the opening from the water jacket side, wherein the member that bridges the gap between the outer wall of the cylinder block and the inner wall of the crankcase is a discharge member inserted into the drain hole, the discharge member having a first end portion into which the coolant can be drawn and a second end portion from which the coolant can be discharged, the discharge member being configured to open the drain passage by moving the first cover member by inserting the discharge member into the drain passage against the predetermined pressure; and a second cover member configured to close the drain hole from the outer side of the crankcase, when the discharge member is not inserted into the drain hole, the method comprising:

removing the second cover member from the drain hole;

inserting the discharge member into the drain hole;

opening the opening of the drain passage by moving the first cover member by inserting the discharge member into the drain passage against the predetermined pressure; and discharging the coolant from the water jacket to the outer side of the crankcase by drawing the coolant into the first end of the discharge member and then discharging the coolant from the second end of the discharge member.

2. The method according to claim 1, wherein the drain passage is formed substantially perpendicular to the axis of the cylinder in the cylinder block;

the drain hole is formed substantially parallel to the drain passage and via which the inner side of the crankcase and the outer side of the crankcase communicate with each other; and the drain passage and the drain hole are aligned substantially coaxially with each other when the compression ratio of the internal combustion engine is equal to the predetermined compression ratio.

* * * * *